US010953678B2

(12) United States Patent
Shih

(10) Patent No.: US 10,953,678 B2
(45) Date of Patent: Mar. 23, 2021

(54) STAMP

(71) Applicant: SUN SAME ENTERPRISES CO., LTD., Tainan (TW)

(72) Inventor: Wen-Jer Shih, Tainan (TW)

(73) Assignee: SUN SAME ENTERPRISES CO., LTD.

( * ) Notice: Subject to any disclaimer, the term of this patent is extended or adjusted under 35 U.S.C. 154(b) by 41 days.

(21) Appl. No.: 15/849,642

(22) Filed: Dec. 20, 2017

(65) Prior Publication Data

US 2019/0009598 A1 Jan. 10, 2019

(30) Foreign Application Priority Data

Jul. 5, 2017 (TW) ..... 106122607

(51) Int. Cl.

| | |
|---|---|
| ***B41K 1/36*** | (2006.01) |
| ***B41K 1/42*** | (2006.01) |
| ***B41K 1/04*** | (2006.01) |
| ***B41K 1/12*** | (2006.01) |
| ***B41K 1/10*** | (2006.01) |
| ***B41K 1/40*** | (2006.01) |

(52) U.S. Cl.

CPC ..... *B41K 1/36* (2013.01); *B41K 1/04* (2013.01); *B41K 1/10* (2013.01); *B41K 1/12* (2013.01); *B41K 1/40* (2013.01); *B41K 1/42* (2013.01)

(58) Field of Classification Search

CPC ... B41K 1/04; B41K 1/10; B41K 1/12; B41K 1/36; B41K 1/40; B41K 1/42

See application file for complete search history.

(56) References Cited

U.S. PATENT DOCUMENTS

| | | | | | |
|---|---|---|---|---|---|
| 668,021 | A * | 2/1901 | Folger et al. | B41K 1/10 | 101/105 |
| 958,533 | A * | 5/1910 | Price | B41K 1/10 | 101/105 |
| 1,094,062 | A * | 4/1914 | Scotford | B41K 1/10 | 101/105 |
| 1,510,327 | A * | 9/1924 | Miller | B41K 1/10 | 101/111 |
| 1,730,365 | A * | 10/1929 | Grabler | B41K 1/10 | 101/105 |
| 3,714,894 | A * | 2/1973 | Robinson | B41K 1/10 | 101/104 |
| 7,654,198 | B2 * | 2/2010 | Faber | B41K 1/36 | 101/105 |
| 2009/0255427 | A1 * | 10/2009 | Faber | B41K 1/04 | 101/334 |
| 2010/0275795 | A1 * | 11/2010 | Ortner | B41K 1/10 | 101/106 |
| 2016/0067993 | A1 * | 3/2016 | Faber | B41K 1/02 | 101/334 |
| 2016/0361936 | A1 * | 12/2016 | Zehetner | B41K 3/56 | |

* cited by examiner

*Primary Examiner* — Matthew G Marini
*Assistant Examiner* — Marissa Ferguson-Samreth
(74) *Attorney, Agent, or Firm* — Su IP Consulting

(57) ABSTRACT

A present disclosure relates to a stamp for applying to a surface. The stamp includes a stamp type unit. The stamp type unit includes a die bracket, a first elastic element, a second elastic element, and a bearing bracket. The bearing bracket includes a type band and operatively associated with the first elastic element, the second elastic element and the die bracket. The first elastic element and the second elastic element are disposed between the die bracket and the bearing bracket in a manner that the type band is level with respect to the surface.

16 Claims, 9 Drawing Sheets

STAMP

CROSS-REFERENCE TO RELATED APPLICATION

Benefit is claimed under 35 U.S.C. § 119(a)-(d) to Taiwan Application No. 106122607 filed on Jul. 5, 2017. The Taiwan Application is hereby incorporated by reference in its entirety.

BACKGROUND

Unless otherwise indicated herein, the approaches described in this section are not admitted to be prior art by inclusion in this section.

The present disclosure relates to a stamp, and more particularly to a self-inking stamp. The self-inking stamp may include a housing and a stamp type unit being upwardly and downwardly displaceable relative to the housing.

FIG. 9 and FIG. 10 illustrate perspective assembly views of a conventional stamp type unit 92. Conventional stamp type unit 92 includes die bracket 90, bearing bracket 91 and two fasteners 93. Bearing bracket 91 is mounted on die bracket 90 with fasteners 93. Bearing bracket 91 may further include type band 95 configured to extend out from lower surface 96 of die bracket 90 and adhesive 83 to apply stamping patterns on rubber die 94 and type band 95 on a surface. Fasteners 93 are located at two edges of bearing bracket 91, respectively. Any of fasteners 93 is configured to penetrate ribs 97 of bearing bracket 91 and fasten bearing bracket 91 to die bracket 90.

Rubber die 94 may be provided to be attached to lower surface 96 of die bracket 90 via adhesive layer 83. To levelly align type band 95 with respect to rubber die 94 and lower surface 96 to appear stamping patterns on a surface, bearing bracket 91 may be moved relative to die bracket 90 by adjusting the two fasteners 93. However, adjusting two different fasteners 93 at two different edges of bearing bracket 91 may not be able to provide one uniform adjustment with respect to rubber die 94 and lower surface 96. In response to two fasteners 93 are not evenly adjusted, type band 95 may incline with respect to rubber die 94 and lower surface 96, which causes ink non-uniformly attached on type band 96 and generates indistinct stamping patterns on a stamping surface.

SUMMARY

In some embodiments of the present disclosure, a stamp for applying to a surface includes a stamp type unit. The stamp type unit may include a die bracket, a first elastic element, a second elastic element, and a bearing bracket. The bearing bracket includes a type band and operatively associated with the first elastic element, the second elastic element and the die bracket. The first elastic element and the second elastic element are disposed between the die bracket and the bearing bracket in a manner that the type band is level with respect to the surface.

In some other embodiments of the present disclosure, a stamp for applying to a surface includes a stamp type unit. The stamp type unit may include a die bracket, a first elastic element, a second elastic element, and a bearing bracket. The bearing bracket includes a type band and operatively associated with the first elastic element, the second elastic element and the die bracket in a manner that the type band is level with respect to the surface. The die bracket may further include a first guiding element configured to receive the first elastic element, and a second guiding element configured to receive the second elastic element.

In yet other embodiments of the present disclosure, a stamp includes a stamp type unit. The stamp type unit may include a die bracket, a first elastic element, a second elastic element, and a bearing bracket. The bearing bracket includes a type band and operatively associated with the first elastic element, the second elastic element and the die bracket in a manner that the type band is level with respect to the surface. The bearing bracket may further define a first guiding groove to receive the first elastic element and a second guiding groove to receive the second elastic element.

BRIEF DESCRIPTION OF THE DRAWINGS

The present invention will become more readily apparent to those ordinarily skilled in the art after reviewing the following detailed description and accompanying drawings, in which.

DETAILED DESCRIPTION

Figure 1:
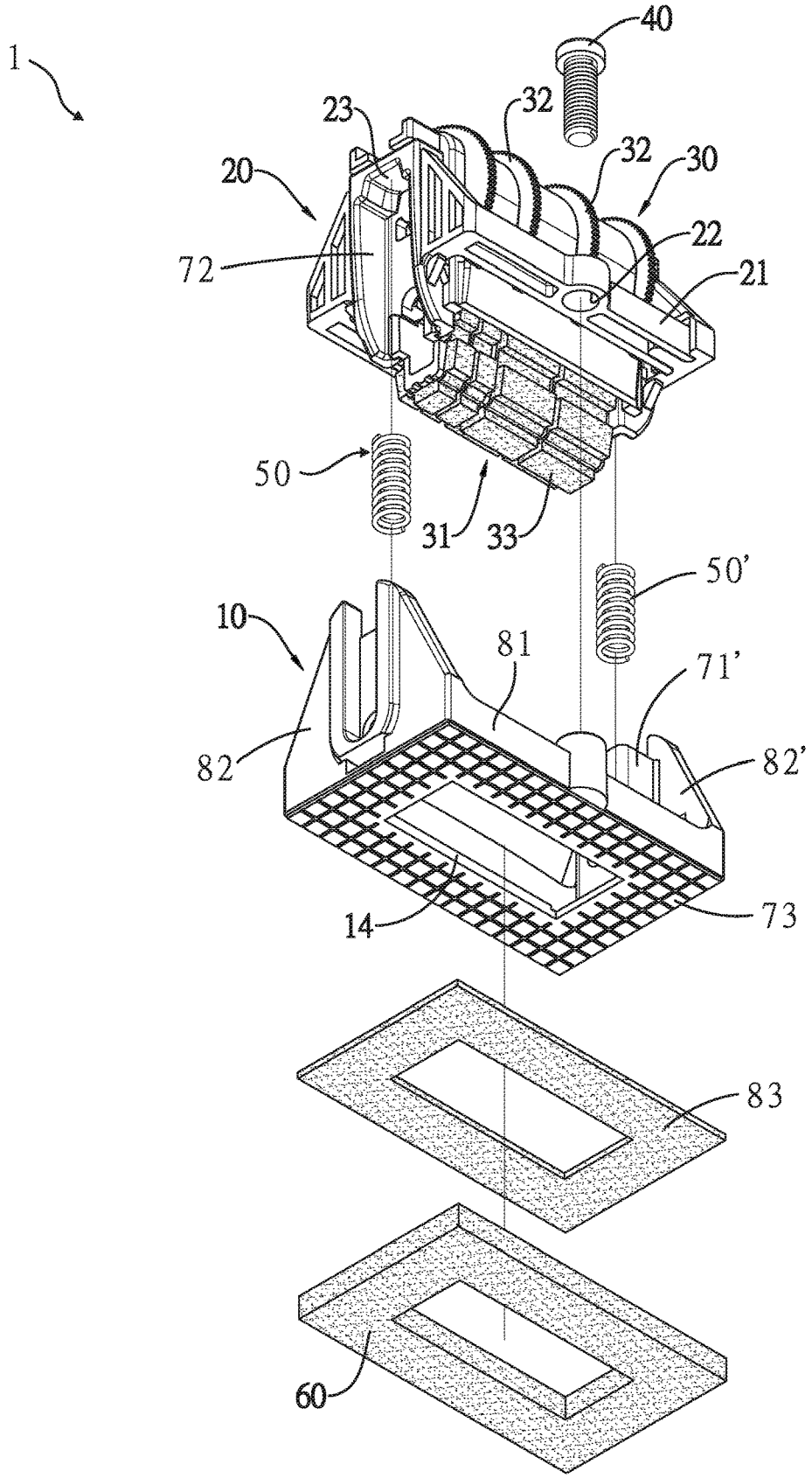
FIG. 1 is an exploded bottom perspective view of a stamp type unit according to some embodiments of the present disclosure.

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments may be utilized, and other changes may be made, without departing from the spirit or scope of the subject matter presented here. It will be readily understood that the aspects of the present disclosure, as generally described herein, and illustrated in the drawings, can be arranged, substituted, combined, and designed in a wide variety of different configurations, all of which are explicitly contemplated herein.

Figure 2:
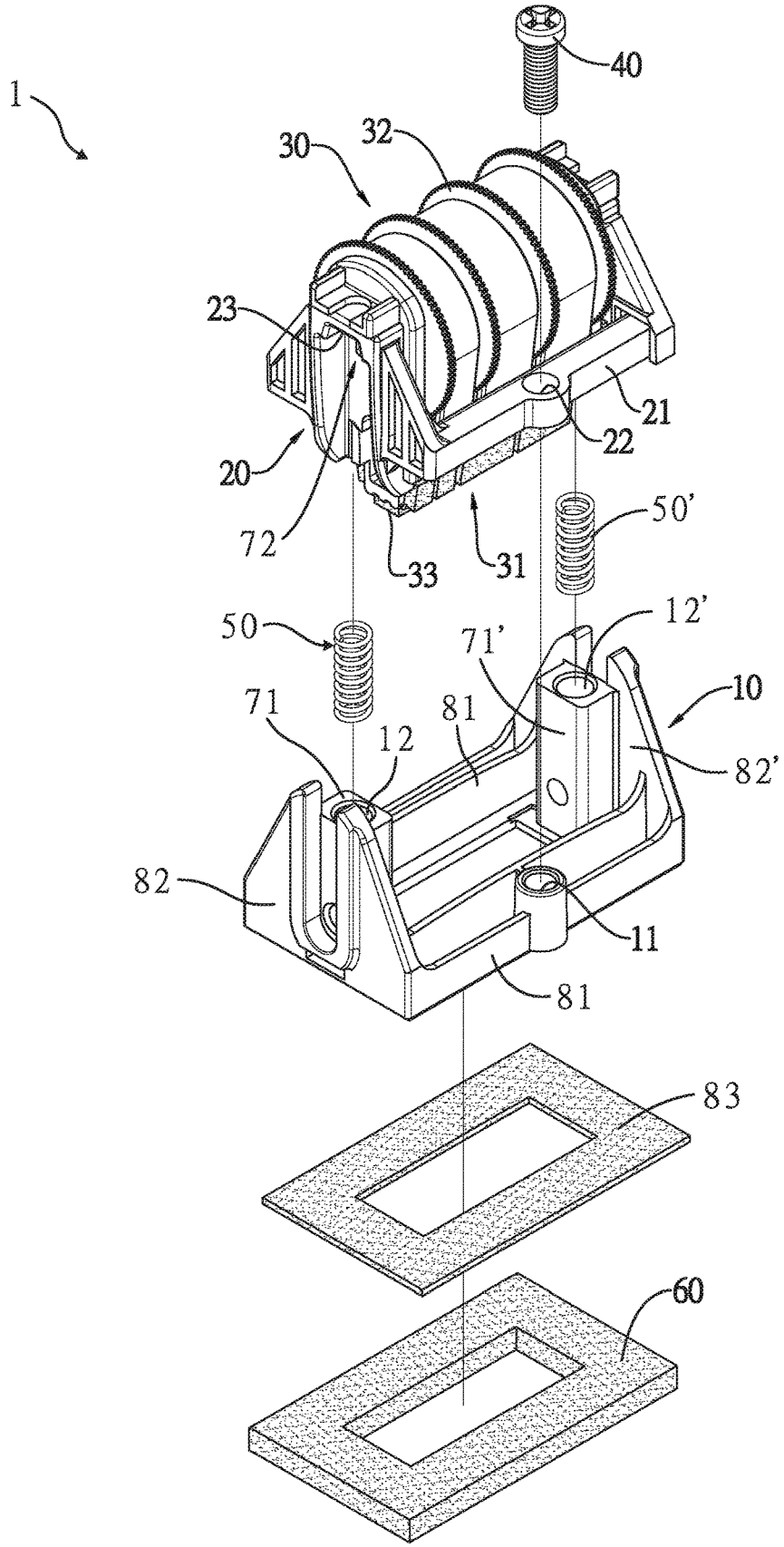
FIG. 2 is an exploded top perspective view of a stamp type unit according to some embodiments of the present disclosure.
Figure 3:
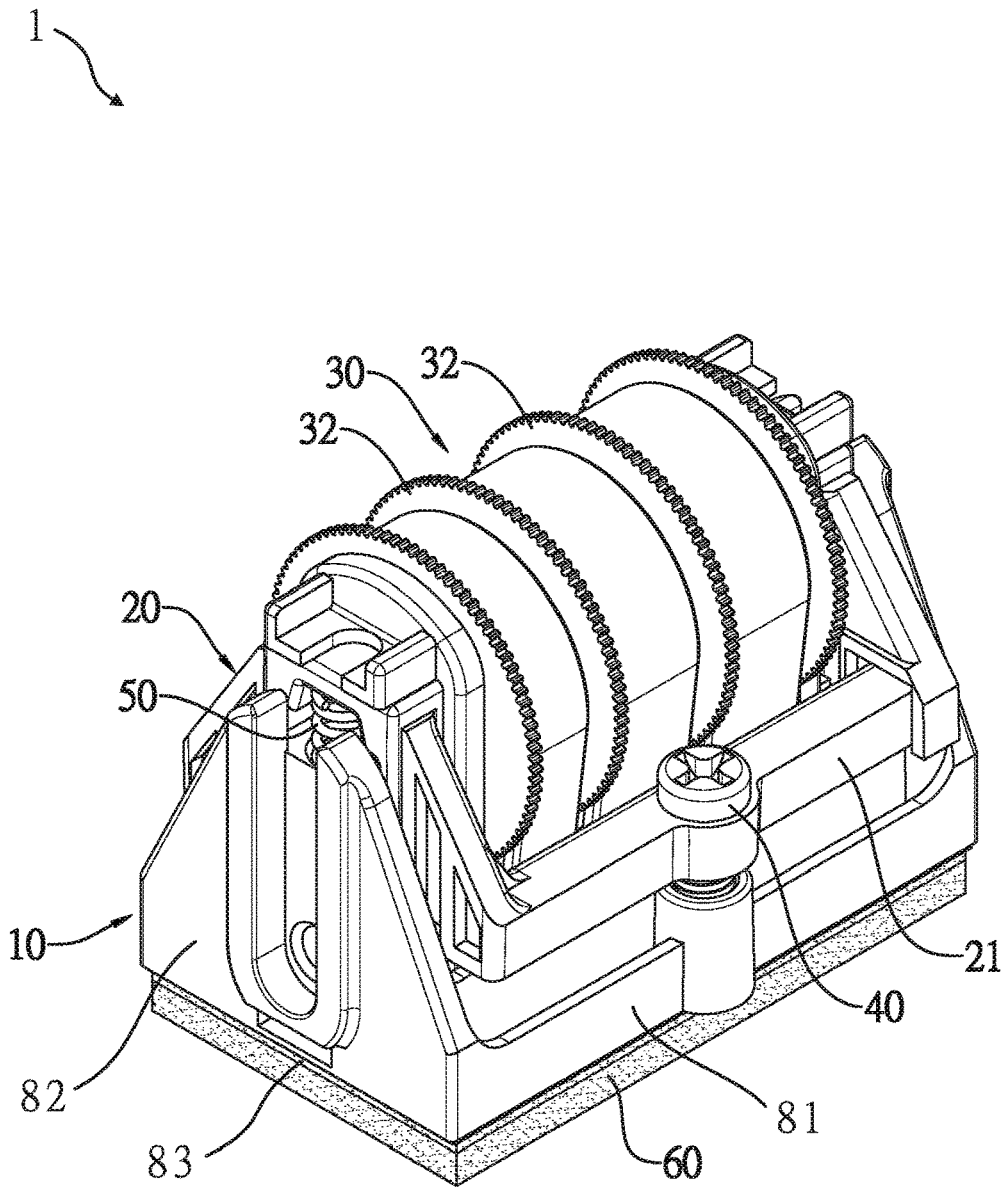
FIG. 3 is a perspective assembly view of a stamp type unit according to some embodiments of the present disclosure.

FIG. 1, FIG. 2 and FIG. 3 illustrate a perspective view of a stamp type unit 1 according to some embodiments of the present invention. In FIG. 1, stamp type unit 1 includes die bracket 10, bearing bracket 20, adjustment assembly 30, fastener 40 and elastic elements 50 and 50'. Bearing bracket 20 may include type band 31. Type band 31 may extend out of bottom opening 14 of die bracket 10. Type band 31 may include stamping plane 33 configured to extend out of die bracket 10 and adhesive layer 83 to provide stamping patterns on a plane. Adjustment assembly 30 may include a plurality of adjustment units 32, which are arranged at an interval and are rotatable to adjust stamping patterns on stamping plane 33.

In some embodiments, bearing bracket 20 is fastened to die bracket 10 with fastener 40. In FIG. 2, die bracket 10 may include first guiding element 71 at a first side of die bracket 10 and second guiding element 71' at a second side of die bracket 10. First guiding element 71 may define first opening 12 and second guiding element 71' may define second opening 12'. In some embodiments, first guiding element 71 is configured to receive first elastic element 50 through opening 12 and second guiding element 71' is configured to receive second elastic element 50' through opening 12'.

In some embodiments, bearing bracket 20 defines at least two guiding grooves 72 at two sides of bearing bracket 20 respectively complementary to guiding elements 71 and 71'. Guiding grooves are configured to receive first elastic element 50 and second elastic element 50', respectively.

In some embodiments, one end of first opening 12 and one end of second opening 12' are closed so that the first opening 12 and the second opening 12' are not communicated with bottom grid pattern 73 of die bracket 10. In some embodiments, rubber die 60 is attached to grid pattern 73 via adhesive layer 83. Adhesive layer 83 may include adhesives on its surfaces corresponding to grid pattern 73 and rubber die 60. For example, adhesive layer 83 may include a first adhesive on its top surface corresponding to grid pattern 73 and a second adhesive on its bottom surface corresponding to rubber die 60.

In some embodiments, adhesive layer 83 may be applied to rubber die 60 before rubber die 60 is attached to grid pattern 73. Grid pattern 73 may provide alignment references for other stamping patterns on rubber die 60 to align with stamping patterns on stamping plane 33.

In some other embodiments, adhesive layer 83 may be applied to grid pattern 73 before rubber die 60 is attached to grid pattern 73. Grid pattern 73 may still be seen after adhesive layer 83 is applied to grid pattern 73. Therefore, grid pattern 73 may provide alignment references for other stamping patterns on rubber die 60 to align with stamping patterns on stamping plane 33.

Compared to convention approach in which grid patterns are printed in batch on adhesive layer 83 or lower surface 96 of die bracket 90, grid pattern 73 is molded as an integrated pattern when die bracket 10 is molded so that grid pattern 73 are the same for every molded die bracket 10. In the conventional approach, printed grid patterns may differ from various batches, which may lead to alignment differences among various batches.

In some embodiments, first elastic element 50 and second elastic element 51' have substantially the same length and the same elasticity and disposed between die bracket 10 and bearing bracket 20. In addition, first elastic element 50 may be exposed from first opening 12 and extended toward bearing bracket 20 to be received in one of guiding groove 72. Similarly, second elastic element 50' may be exposed from second opening 12' and extended toward bearing bracket 20 to be received in the other of guiding groove 72.

In some embodiments, bearing bracket 20 includes rod 21 at a side of bearing bracket 20. Rod 21 may define hole 22 to receive fastener 40. In some embodiments, hole 22 and guiding grooves 72 are substantially in parallel. Corresponding to hole 21, die bracket 10 may also define channel 11 on rod 81 of die bracket 10. In some embodiments, channel 11, first guiding element 71 and second guiding element 71' are substantially in parallel. Rod 81 may be disclosed between first support 82 at a first side of the die bracket 10 and second support 82' at a second side of die bracket 10. First support 82 may be adjacent to first guiding element 71. Similarly, second support 82' may be also adjacent to second guiding element 71'. In some embodiments, fastener 40 may include external threads to pass through hole 22 to engage with internal threads defined in channel 11 to fasten bearing bracket 20 to die bracket 10.

Figure 4:
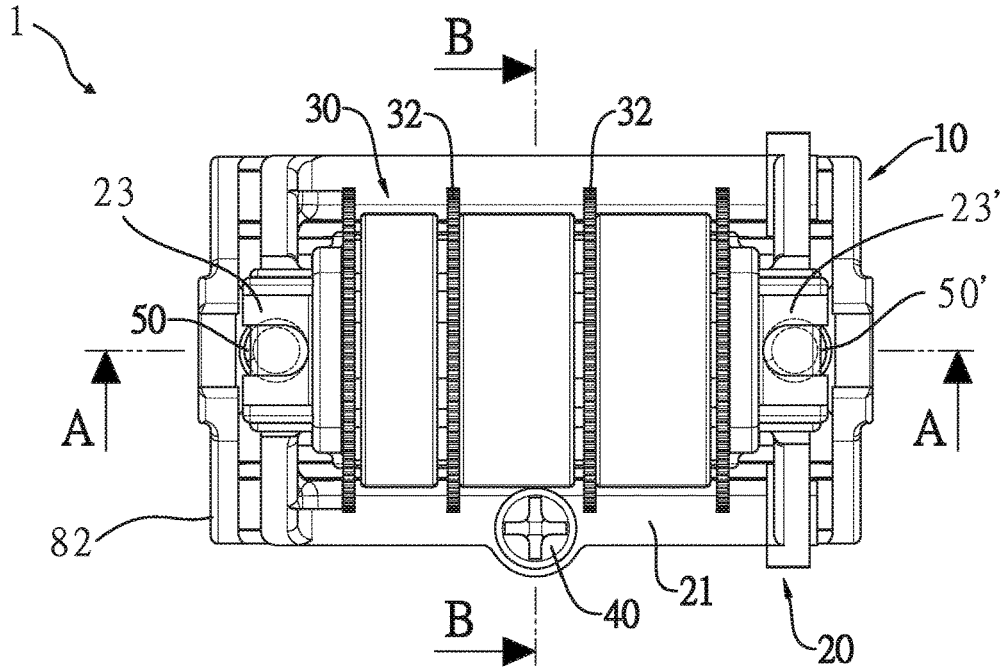
FIG. 4 is a top planar view of a stamp type unit according to some embodiments of the present disclosure.

FIG. 4 is a top planar view of stamp type unit 1, according to some embodiments of the present disclosure. In some embodiments, bearing bracket 20 further includes abutting part 23 to abut against one end of first elastic element 50 and abutting part 23' to abut against one end of second elastic element 50'. In conjunction with FIGS. 1 and 2, abutting parts 23 and 23' are at one terminal of guiding grooves 72. In some embodiments, abutting parts 23 and 23' are configured to respectively cover and abut elastic elements 50 and 50'.

Figure 5:
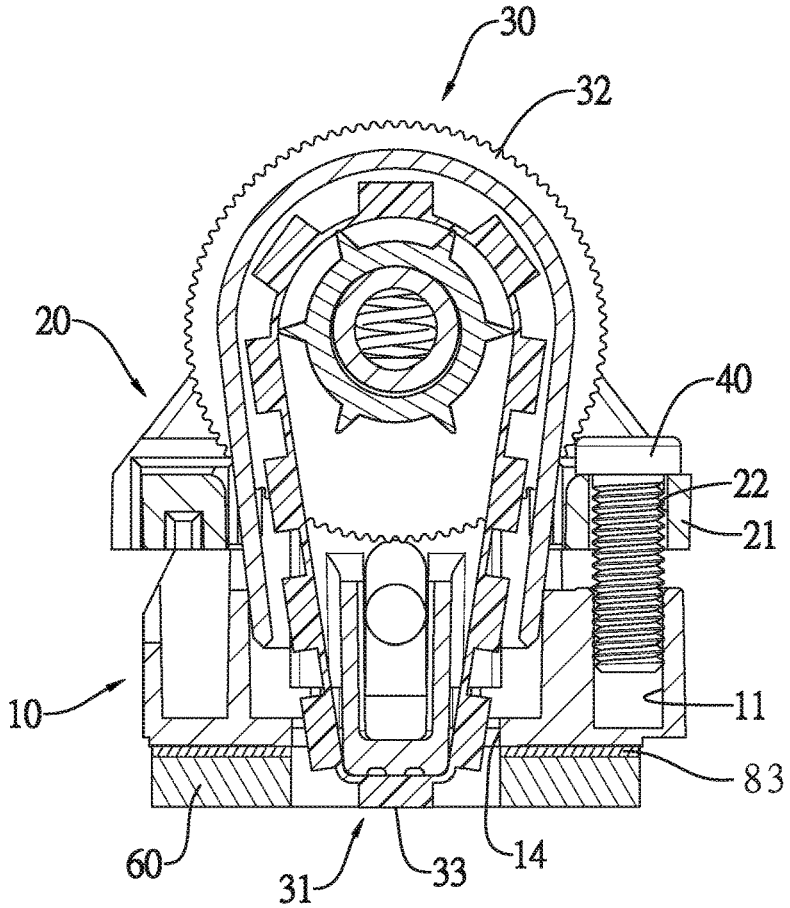
FIG. 5 is a section view of FIG. 4 along a section line B-B.

FIG. 5 is a section view of FIG. 4 along a section line B-B, according to some embodiments of the present disclosure. In conjunction with FIGS. 1 and 2, fastener 40 may configured to pass through opening 22 of bearing bracket 20 and be received in channel 11 of die bracket 10. In some embodiments, fastener 40 may be configured to fasten bearing bracket 20 to die bracket 10. In some embodiments, fastener 40 may be a screw and channel 11 may include screw threads. Fastener 40 may adjust the distance between bearing bracket 20 and die bracket 10 during fastening in a manner that stamping plane 33 of type band 31 is level with respect to rubber die 60 and a surface to be stamped.

Figure 6:
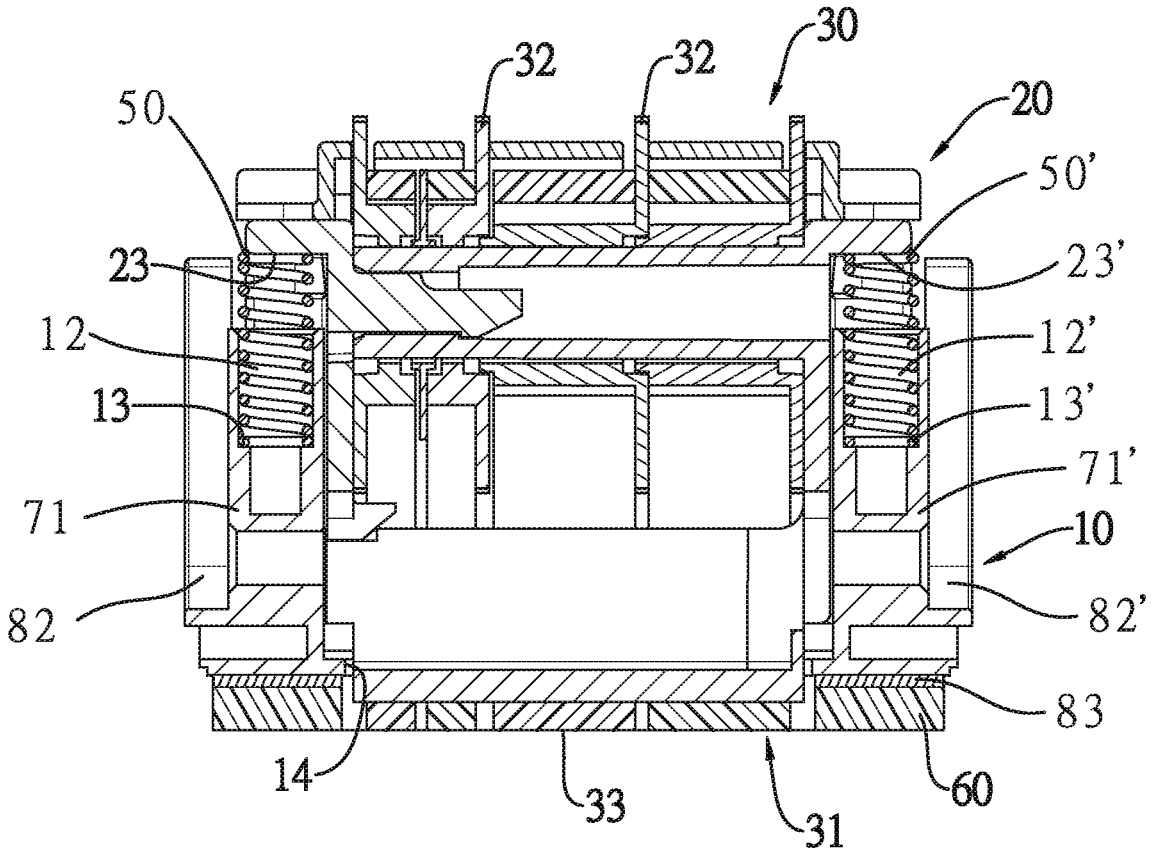
FIG. 6 is a section view of FIG. 4 along a section line A-A.

FIG. 6 is a section view of FIG. 4 along a section line A-A, according to some embodiments of the present disclosure. In conjunction with FIGS. 1 and 2, first elastic element 50 is received in first guiding element 71 and second elastic element 50' is received in second guiding element 71'. In response to fastener 40 fastening bearing bracket 20 toward die bracket 10, first elastic element 50 is compressed between abutting part 23 of bearing bracket 20 and abutting part 13 in opening 12 of first guiding element 71. Similarly, second elastic element 50' is compressed between abutting part 23' of bearing bracket 20 and abutting part 13' in opening 12' of second guiding element 71'. In some embodiments, first elastic element 50 and second elastic element 50' are springs and erect between die bracket 10 and bearing bracket 20. In addition, the axis of first elastic element 50 and second elastic element 50' are substantially parallel to the axis of fastener 40. Elastic elements 50 and 50' are configured to provide an uniform force distribution on type band 31 so that stamping plane 33 of type band 31 is level with respect to rubber die 60 and a surface to be stamped.

Figure 7:
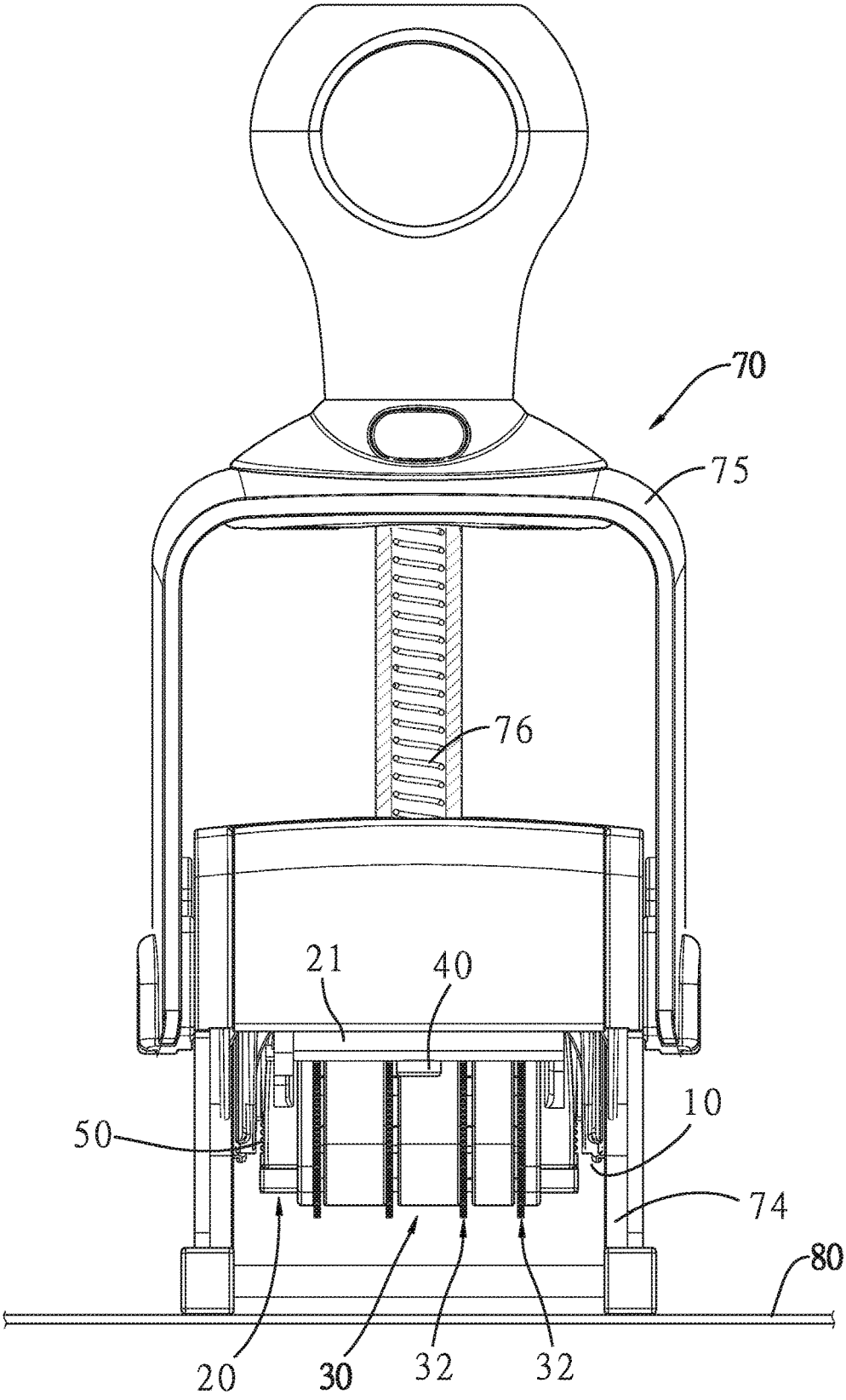
FIG. 7 is a schematic diagram of a stamp including a stamp type unit and a housing to house the stamp type unit in a first state according to some embodiments of the present disclosure.

FIG. 7 is a schematic diagram of stamp 70 in a first state according to some embodiments of the present disclosure. In some embodiments, in addition to the stamp type unit 1 described above, stamp 70 further includes an inner housing 74 to house stamp type unit 1, an outer housing to house inner housing 74 and third elastic element 76. In the first state, no external force is applied to stamp 70 and third elastic element 76 is not being compressed and stamping plane 33 of type band 31 is configured to be in contact with an ink pad (not shown) disposed in inner housing 74.

Figure 8:
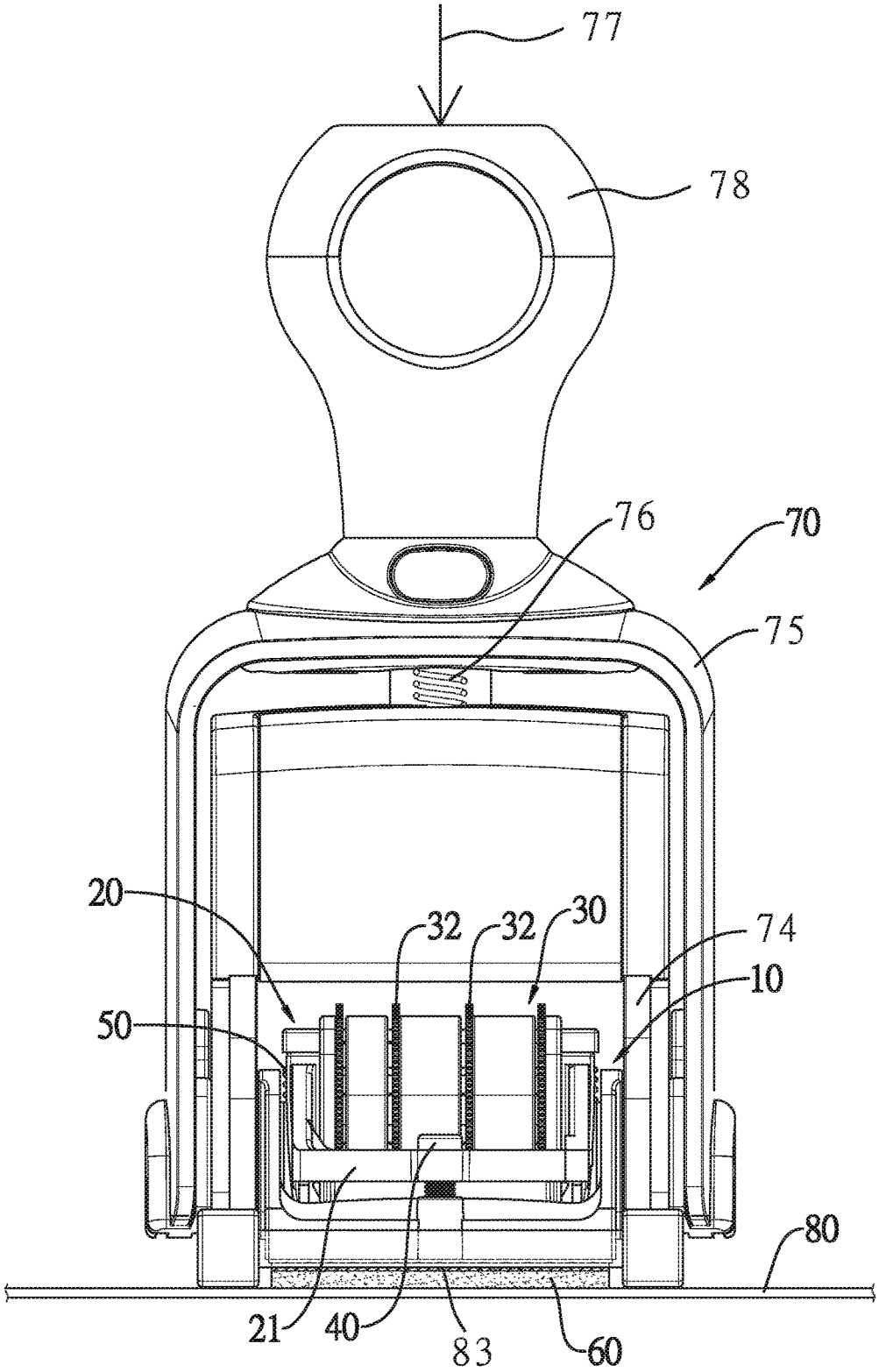
FIG. 8 is a schematic diagram of a stamp including a stamp type unit and a housing to house the stamp type unit in a second state according to some embodiments of the present disclosure.
Figure 9:
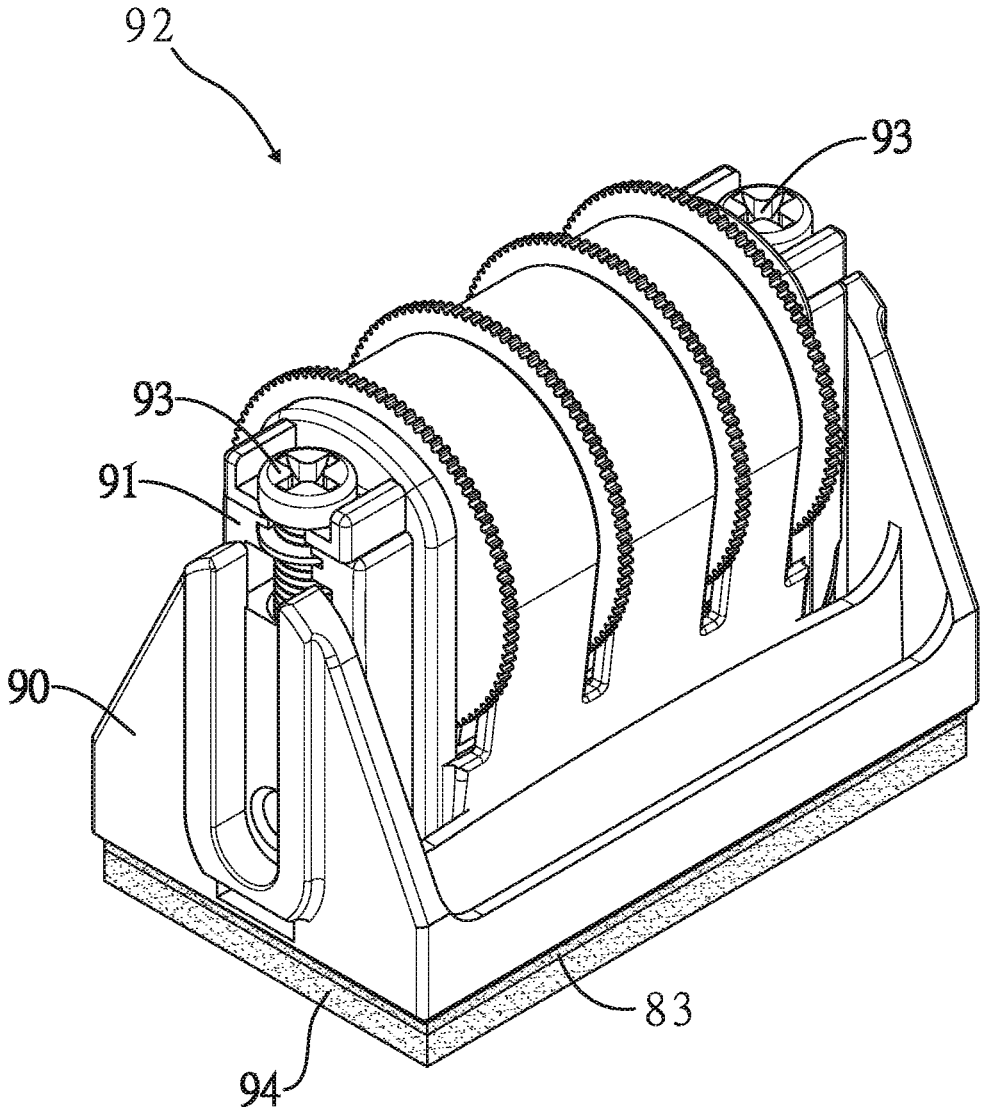
FIG.9 PRIOR ART
FIG. 9 is a perspective assembly view of a conventional stamp type unit.
Figure 10:
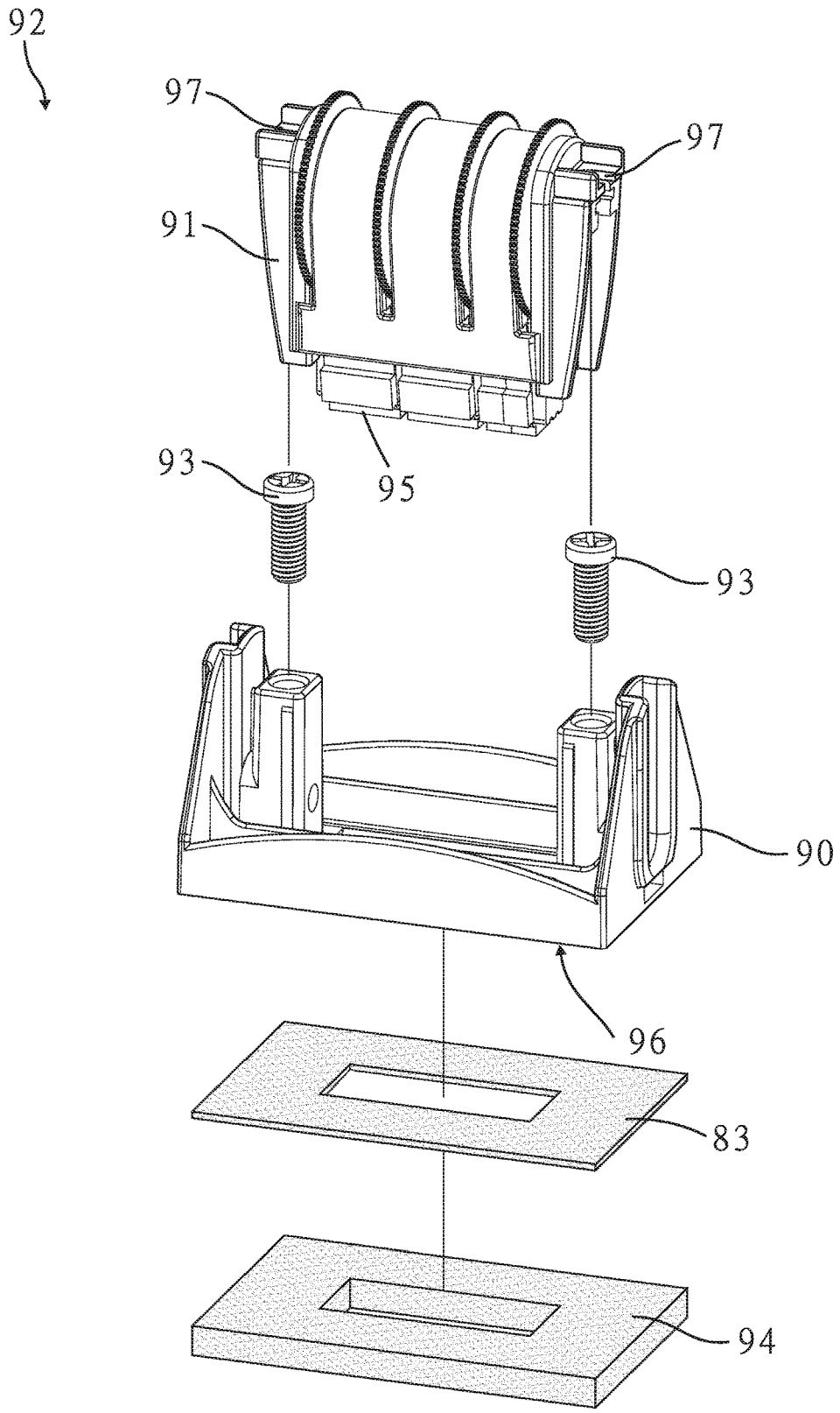
FIG. 10 PRIOR ART
FIG. 10 is an exploded perspective assembly view of a conventional stamp type unit.

FIG. 8 is a schematic diagram of stamp 70 in a second state according to some embodiments of the present disclosure. In the second state, external force 77 is applied to handle 78 of stamp 70. In response to external force 77, third elastic element 76 is compressed and driven stamp type unit 1 rotate and move downwardly so that stamping plane 33 and rubber die 60 is in contact with and stamp on stamping surface 80.

As illustrated in FIG. 5 and FIG. 6, fastener 40 is configured to engage with die bracket 10. Bearing bracket 20 may be movable relative to fastener 40 and coordinates with the first elastic element 50 and the second elastic element 50' that provide appropriate deformation in response to forces applied by fastener 40. As illustrated in FIG. 8, to perform stamping, the appropriate deformation of first elastic element 50 and second elastic element 50' may minimize an obliqueness error of type band 31. In addition, in conjunction with FIGS. 5 and 6, an alignment error of stamping plane 33 of type band 31 and rubber die 60 may also be minimized with the appropriate deformation of first elastic element 50 and second elastic element 50'. Therefore, type band 31 may be free from obliqueness. In addition, stamping plane 33 of type band 31 may be levelly aligned with rubber die 60, such that ink may be uniformly attached on type band 31 and type band 31 may reliably abut on surface 80 to stamp.

In conclusion, fastener 40 of the stamp is capable of vertically moving up and down to adjust the height of adjustment assembly 30 as well as moving relative to die bracket 10 through bearing bracket 20, and coordinates with appropriate deformation of elastic elements 50 and 50'. Further, fastener 40 and elastic elements 50 and 50' form a three-point plane to increase the uniformity in forces to enhance the stamping quality.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A stamp for applying to a surface, comprising:
a stamp type unit, comprising:
a die bracket;
a first elastic element;
a second elastic element;
a bearing bracket having a type band and operatively associated with the first elastic element, the second elastic element and the die bracket, wherein the first elastic element and the second elastic element are disposed between the die bracket and the bearing bracket in a manner that the type band is level with respect to the surface, and the first elastic element is disposed at a first side of the die bracket and the second elastic element is disposed at a second side of the die bracket; and
a fastener configured to fasten the bearing bracket to a third side of the die bracket along a direction substantially in parallel with the first elastic element and the second elastic element, and to compress the first elastic element and the second elastic element from the third side of the die bracket.

2. The stamp of claim 1, wherein the first elastic element and the second elastic element have substantially the same length and the same elasticity.

3. The stamp of claim 1, wherein the first side of the die bracket is complementary to a first side of the bearing bracket, and the second side of the die bracket is complementary to a second side of the bearing bracket.

4. The stamp of claim 1, wherein the third side of the die bracket corresponds to a third side of the bearing bracket.

5. A stamp for applying to a surface, comprising:
a stamp type unit comprising:
a die bracket;
a first elastic element;
a second elastic element;
a bearing bracket having a type band and operatively associated with the first elastic element, the second elastic element and the die bracket in a manner that the type band is level with respect to the surface; and
a fastener configured to fasten the bearing bracket to a side of the die bracket along a direction substantially in parallel with the first elastic element and the second elastic element, and to compress the first elastic element and the second elastic element from the side of the die bracket,
wherein the die bracket further comprises: a first guiding element configured to enclose a first part of the first elastic element and to expose a second part of the first elastic element from a first opening of the first guiding element, and a second guiding element configured to enclose a first part of the second elastic element and to expose a second part of the second elastic element from a second opening of the second guiding element.

6. The stamp of claim 5, wherein one end of the opening is closed so that the opening is not communicated with a bottom of the die bracket.

7. The stamp of claim 5, wherein the first elastic element extends toward the bearing bracket.

8. The stamp of claim 5, wherein the stamp further comprises a housing configured to house the stamp type unit, and the housing further includes a third elastic element.

9. The stamp of claim 5, wherein the die bracket includes a bottom surface defining a grid pattern.

10. The stamp of claim 8, wherein the die bracket includes a rod defining a channel to receive the fastener.

11. The stamp of claim 10, wherein the channel, the first guiding element, and the second guiding element are substantially in parallel.

12. A stamp for applying to a surface, comprising:
a stamp type unit comprising:
a die bracket;
a first elastic element;
a second elastic element;
a bearing bracket having a type band and operatively associated with the first elastic element, the second elastic element and the die bracket in a manner that the type band is level with respect to the surface; and
a fastener configured to fasten the bearing bracket to a side of the die bracket along a direction substantially in parallel with the first elastic element and the second elastic element, and to compress the first elastic element and the second elastic element from the side of the die bracket,
wherein the bearing bracket further defines a first guiding groove to receive the first elastic element including a first part enclosed in the die bracket and a second part exposed from the die bracket and a second guiding groove to receive the second elastic element including a first part enclosed in the die bracket and a second part exposed from the die bracket.

13. The stamp of claim 12, wherein the first guiding groove includes a first abutting part configured to be in contact with the first elastic element.

14. The stamp of claim 12, wherein the bearing bracket further comprises a rod defining a hole to receive the fastener.

15. The stamp of claim 14, wherein the hole, the first guiding groove, and the second guiding groove are substantially in parallel.

16. The stamp of claim 12, wherein the first guiding groove is complementary to a first guiding element of the die bracket.

* * * * *